United States Patent [19]

Leirnes et al.

[11] Patent Number: 4,512,798

[45] Date of Patent: Apr. 23, 1985

[54] METHOD FOR PRODUCING LEAD FROM SULPHIDIC AND OXIDIC AND/OR SULPHATIC LEAD RAW MATERIALS

[75] Inventors: Johan S. Leirnes, Skelleftehamn; Malkolm S. Lundström, Skellefteå; Martin L. Hedlund, Ursviken; Kurt J. A. Burén, Skelleftehamn, all of Sweden

[73] Assignee: Boliden Aktiebolag, Stockholm, Sweden

[21] Appl. No.: 605,665

[22] Filed: Apr. 30, 1984

[30] Foreign Application Priority Data

May 5, 1983 [SE] Sweden ..... 8302584
May 5, 1983 [SE] Sweden ..... 8302585

[51] Int. Cl.[3] ..... C22B 13/02
[52] U.S. Cl. ..... 75/3; 75/77
[58] Field of Search ..... 75/77, 3

[56] References Cited

U.S. PATENT DOCUMENTS 2,116,679 5/1938 Gohre ..... 75/3
2,984,562 5/1961 Kohlmeyer ..... 75/77
3,663,207 5/1972 Themelis et al. ..... 75/77
4,008,075 2/1977 Petersson ..... 75/77

FOREIGN PATENT DOCUMENTS 0045532 2/1982 European Pat. Off. ..... 75/77

*Primary Examiner*—M. J. Andrews
*Attorney, Agent, or Firm*—Burns, Doane, Swecker & Mathis

[57] ABSTRACT

The invention relates to a method for producing lead from moist lead-sulphide concentrates and oxidic and/or sulphatic lead raw materials by the known roasting and reaction process. According to the method granules or pellets of oxidic and/or sulphatic lead raw materials are brought together with the moist lead concentrate in a drum-like vessel arranged for rotation about its longitudinal axis. Said moist concentrate is dried while rotating said drum-like vessel to form sulphide-containing granulates. The formed granulates are introduced into a furnace together with flux in given proportions. The charge is vigorously agitated and turbulence created in the resultant melt, while effecting the roasting and reaction process to form a liquid slag and a molten lead phase.

Both the drying and the smelting may be provided in the same unit if a top-blown rotary converter is employed.

11 Claims, 6 Drawing Figures

METHOD FOR PRODUCING LEAD FROM SULPHIDIC AND OXIDIC AND/OR SULPHATIC LEAD RAW MATERIALS

The present invention relates to a method for producing lead from moist lead-sulphide concentrates and oxidic and/or sulphatic lead raw materials, by means of a metallurgical process known as the roasting and reaction process. The invention particularly relates to the working-up of sulphidic concentrates and oxidic intermediate products. Such intermediate products, which may be fully or partially sulphated, are obtained when metallurgically treating complex sulphide concentrates, for example when producing lead, zinc or copper from such concentrates.

The roasting and reaction method for producing lead from lead sulphide and lead oxide or lead sulphate has long been known. The method is based on the chemical reactions $$PbS + 2PbO \rightarrow 3Pb + SO_2$$

$$PbS + PbSO_4 \rightarrow 2Pb + 2SO_2$$

The earliest known roasting and reaction processes included methods which were carried out in reverberatory furnaces, in which the roasting of sulphides was followed by a reaction between the lead oxide and the remaining sulphide. The temperature was held as low as possible, to avoid undesirable fuming-off of the lead. No liquid slag is formed, and the gangue remains in a solid form and is extremely rich in lead. When applying such processes, it is possible to recover directly 60–70% of the lead content of the ore, in the form of a highly pure lead. In more modern methods the roasting and reaction process is effected simultaneously in an open-hearth furnace, the lead ore being allowed to float on the surface of the lead phase formed. Lead oxide and lead sulphate, the formation of which is accelerated by supplying air of oxidation to the process, react with the sulphide at the very moment they are formed. One roasting and reaction process which was previously widely applied is the so-called Newnam open-hearth method, in which a mixture of lead-sulphide ore crushed to a particle size of up to about 20 mm and 10–20% carbon were placed in a thin layer on a lead bath on the hearth. By injecting blast air into the mixture, the mixture is brought to a dark red heat, whereafter the mixture is mechanically agitated. The lead formed by the reaction is collected in the hearth, while the lightly sintered gangue is raked off.

As a result of the development of flotation techniques, enabling concentrates containing 70–80% Pb to be produced, it became impossible to smelt lead in accordance with conventional techniques by sintering and smelting in shaft furnaces, without first thinning the concentrate. The use of the Newnam open-hearth was also troublesome due to the large quantities of slag and vapour formed. In addition, the fine-grain material was difficult to handle on the hearth, and also gave rise to serious environmental problems.

Against this background there was developed in the 1940's the so-called Boliden method, which was originally concerned with the smelting of lead sulphide concentrates together with oxidic and sulphatic dust products, in an electric furnace. When practicing this method, the lead formed contains large quantities of sulphur, which has to be removed in a subsequent conversion process. For various reasons, the Boliden method was modified to include a preceding partial roasting of the concentrate in a multihearth furnace, wherewith a larger part of the lead phase was formed in accordance with the roasting and reaction principle. In accordance with a further modification of the method, there is first produced on a belt-sintering machine a partially desulphurized lead sinter, which is then smelted in an electric furnace in accordance with the original method. The Boliden method in its various development stages is described in, inter alia, US-A-2,416,682, US-A-2,803,532 and DE-C-932 521.

One disadvantage with these old roasting and reaction versions of the Boliden method is that the lead obtained in the roasting and reaction process contains so much sulphur that it is necessary to oxidize off the major part of said sulphur in a converter incorporated in a separate, subsequent stage. Naturally, this greatly increases labour and apparatus costs, and requires the provision of roasting or sintering apparatus for pretreating the charge.

In the middle of the 1960's, the Boliden method was modified to a flash-smelting method for direct smelting of lead from high-grade lead concentrates, thereby obviating the need of a pre-treatment stage and also departing from the roasting and reaction principle at the same time. As with all other autogenous smelting processes, such as our previous Lead Kaldo process described in US-A-4,008,075, the flash-smelting method described, for example in US-A-3,563,726, however, is greatly dependent upon the availability of a substantially constant concentrate composition. Consequently, when practicing the autogenous smelting method it is not possible to work-up lean and rich concentrates in one and the same furnace unit without encountering problems. In addition, in the autogenous-smelting process the concentrates must be substantially dry, and hence the concentrates, which are kept moist during their transportation, must be subjected to an energy-consuming separate drying operation, prior to being charged to the furnace. Environmental problems caused by dust-formations may arise when drying the concentrates, and a certain amount of oxidation may take place. Moreover, it has not been possible to eliminate the need of a separate de-sulphurizing step in the converter, resulting in unnecessarily high handling costs. Consequently, there is a need for a method which enables moist concentrates to be used as a suitable starting material in the smelting of lead, without first needing to dry the concentrate and without giving rise to troublesome environmental problems.

With the aim of avoiding the aforedescribed disadvantages associated with such lead smelting methods, and therewith provide a more flexible lead process while enabling refined lead to be produced in one and the same furnace unit from concentrates kept moist during transportation, and to eliminate the need of a separate working-up process for oxidic and sulphatic lead intermediate products, there is proposed in accordance with the invention a new method in which the roasting and reaction process is utilized in a hitherto unsuggested fashion. The method is characterized by the process steps set forth in the folowing claims.

Thus, in accordance with the invention the roasting and reaction process is carried out while forming liquid slag, similar to the Boliden-method, but while vigorously agitating the charge and creating turbulence in the resultant melt, while employing a charge comprising both sulphide and oxide and/or sulphate in given proportions. These proportions can be selected so that substantially stoichiometric quantities of lead oxide and/or lead sulphate together with lead sulphide are incorporated in the charge. The roasting and reaction process according to the present invention provides employing moist lead-sulphide concentrates to be processed without first drying the concentrates.

According to the present method, granules are produced while simultaneously drying the concentrate, starting from a lead concentrate which has become moist prior to transportation, and separately granulated pellets of lead-oxide and lead-sulphate material, primarily return dust derived from dust hoppers and steam boilers in gas purifying systems used in copper smelters etc. These separately granulated pellets are charged to a drum-like vessel together with the moist lead-sulphide concentrate, said vessel being arranged to rotate about its longitudinal axis. The vessel may have the form of a conventional granulating drum provided with heating facilities, for example provided with an oil burner or with infra-red heating means. The granulating drum is suitably positioned so that the dried granules can be transferred directly to charging hoppers or the like associated with a stationary-type smelter in which the roasting and reaction process is carried out. The dried granules can be fed to the furnace continuously, for example with the aid of screw conveyers and shoot pipes.

Particular advantages are afforded when the granulating unit is a top-blown rotary converter, for example of the Kaldo type, particularly as such a converter can also be used for the continued smelting of lead in accordance with the roasting and reaction process as described hereinafter.

In accordance with the method according to the present invention, the moist concentrate is dried while being constantly in contact with pellets of lead-oxide and lead-sulphate material present in the granulating vessel, said pellets normally being between about 3 mm and 20 mm in size and being thoroughly mixed during the drying process, by rotation of the granulating vessel about its longitudinal axis. This mixing of the pellets with the concentrates, while drying the concentrates at the same time, will result in larger agglomerates, containing both dried sulphide concentrate and oxide-sulphate pellets. Under ideal mixing conditions and supply of material, the lead sulphide will form a dry shell around the pellets supplied.

The smelting of thus formed granulates according to the roasting and reaction process can be effected in various kinds of known furnaces, and the charge can be agitated in a number of known ways. When the furnace unit used comprises stationary reactors, tippable converters of the LD or OBM type are very suitable, for example—the charge is best agitated pneumatically, this being effected by introducing into the melt a stream of gas in measured quantities and pressure, so as to create turbulence in the melt in a manner known per se. In this latter respect, the gas can be introduced into the melt in various ways, for example from the top, from beneath or from the side, with the aid of lances, tuyeres or like devices.

Another preferred method of agitating the melt is through the agency of mechanical agitators, there being preferred in this respect a furnace in which agitation can be effected by rotating the furnace. A particularly preferred type of furnace is a top-blown rotary converter, for example of the Kaldo type. Suitable agitation in respect of the method according to the invention is obtained when the furnace is caused to rotate at a peripheral speed, measured at the interior surface, of about 0.3–3 m/s, suitably 1–2 m/s.

The invention will now be described in more detail, inter alia with reference to the accompanying drawings. The FIGS. 1–3 illustrate how the method is carried out employing various types of furnaces.

Figure 4:
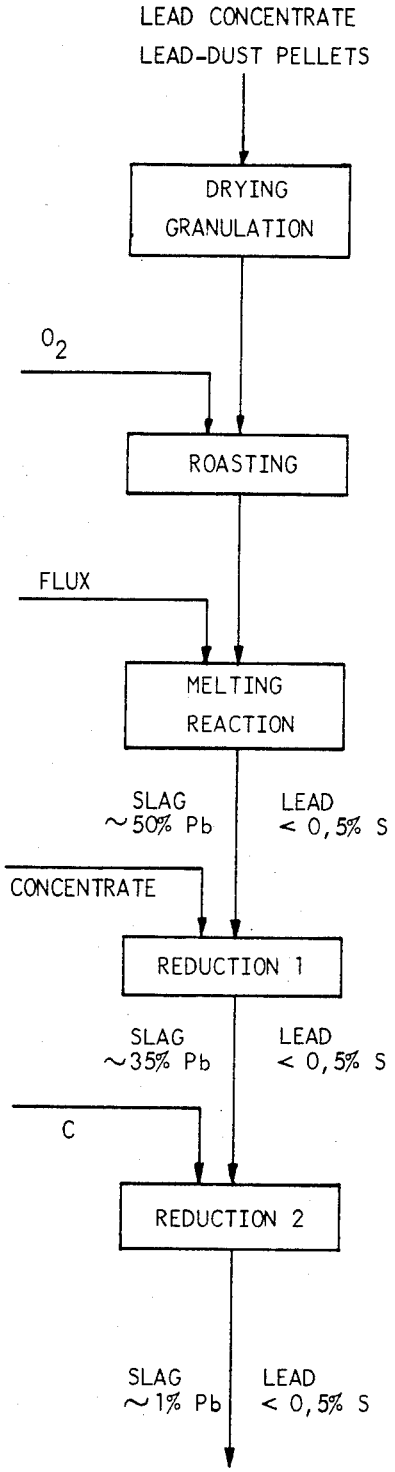
Figure 5:
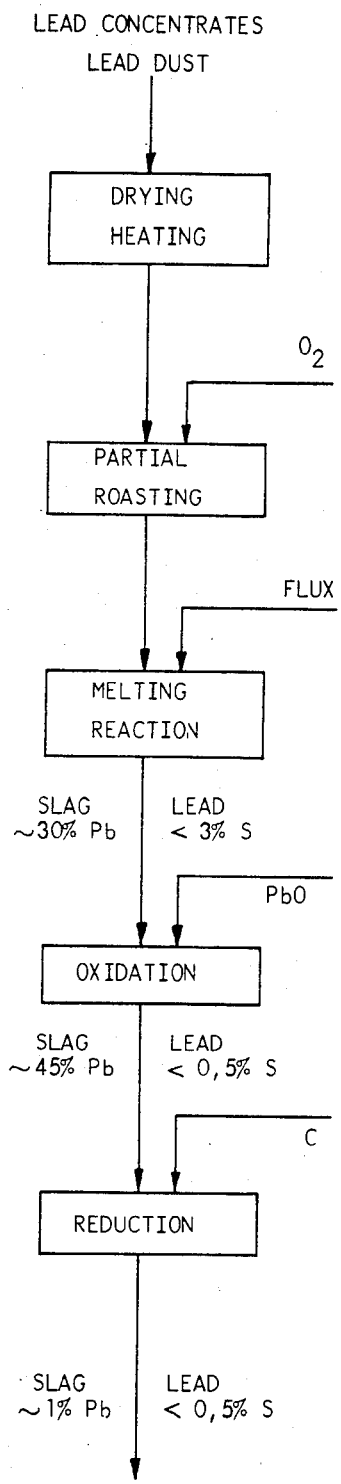

The FIGS. 4 and 5 are block schematics of two preferred embodiments of the invention. Thus, FIG. 4 illustrates one embodiment in which a substantially sulphur-free lead phase is obtained in the roasting and reaction process, while FIG. 5 illustrates an embodiment in which the lead phase obtained contains sulphur, which must be eliminated in a further process stage.

Figure 1:
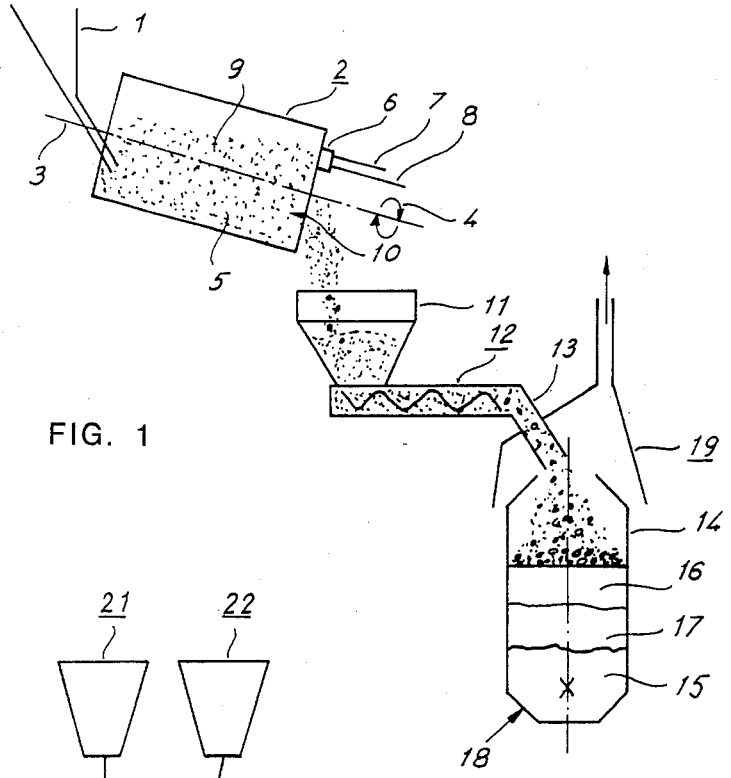
FIG. 1 illustrates the employment of a separate granulating vessel and a stationary furnace.

FIG. 1 illustrates a preferred embodiment of the method according to the invention, in which the final lead smelting stage is carried out in a stationary converter of the LD-type. The reference 1 identifies a pellet and concentrate supply means, it being possible to introduce said pellets and concentrate separately or together. In this respect, one or more supply means may be used for supplying the pellets and concentrate to a granulating means 2, which in the illustrated embodiment has the form of an inclined drum arranged for rotation about its longitudinal axis 3. As indicated by the arrows 4, the granulating drum 2 rotates at a speed of about 0.3 m/s, measured at its inner periphery. The charge 5 located in the drum 2 and originally comprising oxidic-sulphatic pellets and fine-grain, moist sulphide concentrate, is heated during the rotation of the drum 2, with the air of a burner 6 to which oil and oxygen are supplied in the manner indicated by lines 7 and 8. The burner flame 9 is set so as to sweep over the charge with a neutral or weakly reducing flame, in order to avoid, as far as possible, oxidation of the sulphide in the initial stages. The charge is heated so as to maintain a charge temperature of at most about 300° C., although normally the temperature is from 150° to 250° C. The dried, granulated end product is removed over a spillway 10 arranged in one end wall of the drum 2, and is collected in a hopper 11, from which the granules are transported by means of a screw conveyer 12 and charged, either intermittently or continuously, via a shoot-pipe or gravity-pipe 13, to a converter 14 which can be tipped about the axis X located perpendicular to the illustrated plane, and in which lead is produced in accordance with the roasting and reaction process, i.e. by reaction between the constituents of the charged granules, namely PbS, which reacts with PbO and $PbSO_4$, and also optionally with basic lead sulphate, i.e. compounds between PbO and $PbSO_4$, to form a lead phase 15 and a slag layer 16, on which the charged granules are shown to rest. Between the two products there is shown an imaginary zone 17 in which the reactions are thought to take place, to form sulphur-dioxide, metallic lead and slag. As a result of agitating the melts, fresh material is constantly taken from the surface of the bath and admixed with the melt in zone 17 while maintaining the roasting and reaction process in the melt, said melt being agitated in the illustrated embodiment by blowing gas through said melt, in the manner indicated by the arrow 18. The converter 14 is supplied with heat in some suitable manner, in order to maintain the melt at a temperature of between about 1050° C. and 1150° C. Preferably, the converter is heated by means of a burner arranged vertically through the charging opening. In the roasting and reaction process, sulphur-dioxide is also formed in addition to a lead phase and slag, the sulphur-dioxide being carried up through the melt with the agitating gas supplied at 18, and is removed through a hood 19 and transported to a gas-purifying system, in which entrained dust can be separated and returned to the system subsequent to being granulated, and the sulphur-dioxide is concentrated and recovered for the manufacture of sulphuric acid or concentrated sulphur-dioxide.

Figure 2:
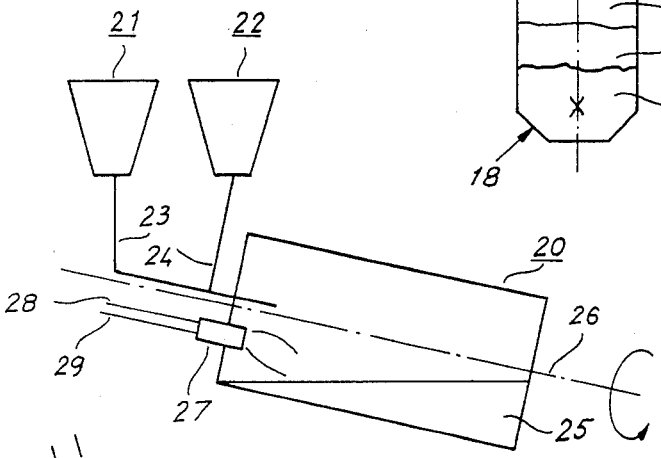
FIGS. 2, 3A and 3B illustrate mutually different embodiments employed while using a rotary converter as the granulating unit.

FIG. 2 illustrates schematically a top-blown rotary converter, generally referenced 20, to which pellets can be charged from a container 21 and moist concentrate from a container 22, through conduits 23, 24, while rotating the converter 20 in its operational position. Initially, the material supplied to the converter forms an intimate mixture of pellets and concentrate, this mixture being generally referenced 25. The mixture is heated while rotating the converter 20 about its longitudinal axis 26 at a speed of about 0.3 m/s, measured on the interior surface of said converter. The charge is heated by means of an oil/oxygen burner 27, to which oil and oxygen are supplied in the manner shown by lines 28 and 29. In this embodiment, the temperature during heating is less critical than that of the FIG. 1 embodiment, since any lead formed during the drying process will not cause any disturbances in the process. Subsequent to converting the charge to a dried, agglomerated sulphide-oxide/sulphate product, the process can be continued in a number of ways. For example, the sulphide part of the product can be partially roasted, by supplying oxygen through the burner 27 in order, for example, to set a stoichiometric relationship between oxide/sulphate and sulphide. A flux is then added and the charge is smelted by raising the temperature with the burner 27 during roasting and reaction to form a slag and a lead phase, as described in more detail in our earlier mentioned coterminous patent application.

Figure 3A:
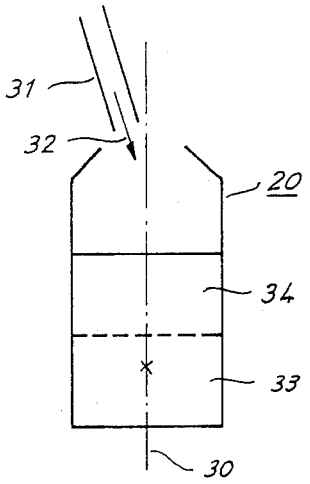
Figure 3B:
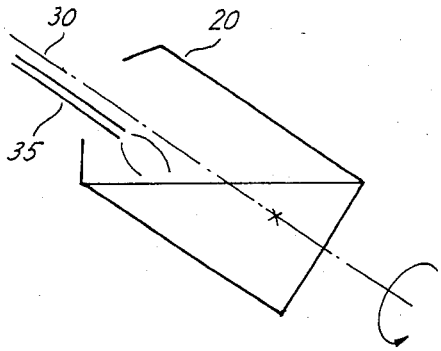

FIG. 3 illustrates another way of carrying out the method with the aid of a top-blown rotary converter 20. The converter can be tilted about an axis X extending at right angles to the plane, and is arranged for rotation about its longitudinal axis 30. FIG. 3A illustrates how the converter 20 is charged in its vertical position. The pellets and concentrates are charged, either as a mixture or separately, via a shoot pipe 31, in the manner shown by arrow 32. In the illustrated embodiment, the pellets and sulphide concentrate have been charged separately, and consequently two layers are shown, i.e. a lower layer 33 suitably comprising pellets, and an upper layer 34 comprising sulphide concentrate. As will be understood, the two materials may also be charged alternately, so as to form in the converter a multiple of alternating pellet layers 33 and sulphide layers 34. Subsequent to charging the complete charge, or a part thereof to the converter, the converter is tipped to its rotary position, as illustrated in FIG. 3B, and the charge is dried and heated with the aid of a burner 35, either in one single moment, or, when the charge is introduced in the form of a plurality of smaller part-charges, in a number of stages, subsequent to introducing each part-charge. During the simultaneous drying and granulating process, the converter is rotated at a peripheral speed of about 0.3 m/s, measured on its inner wall. The temperature in the converter is maintained at 200°-500° C. When the charge has dried, and the sulphide and oxide pellets have been agglomerated into larger granules, the actual lead-manufacturing process can be commenced, as beforedescribed.

In the embodiment of the invention illustrated as a flow sheet in FIG. 4, the charge is first roasted so that the sulphide present is brought to substantially stoichiometric quantities, whereafter flux is added and the reaction initiated to smelt the charge. Upon completion of the reaction there is obtained a substantially sulphur-free lead phase, together with a slag of high lead content. The lead present in the resultant slag is then reduced under turbulence to a content of about 1%, whereafter the slag is tapped-off and separated from the lead phase. Suitably, in this respect lead sulphide is used as a reducing agent until the lead content of the slag is approximately 35%, whereafter coke or some other solid carbonaceous reductant is used to further reduce the slag to a desired final lead content beneath 35%.

In the second embodiment of the invention illustrated as a flow sheet in FIG. 5 there is first carried out a sole partial roasting process, i.e. a process in which the charge is roasted to a residual sulphide content greater than the stoichiometric content, whereafter flux is added and reaction and smelting initiated, in the same manner as described above. Upon completion of the reaction there is obtained a sulphur-containing lead phase and a slag, whose lead content is lower than that of the slag obtained in the first embodiment. The lead content of the slag is then raised, for example by adding additional material containing lead-oxide, whereafter turbulence is again created in the molten bath, the sulphur content of the lead phase being oxidized by the action of the raised lead-oxide content of the slag. Alternatively, the lead-oxide addition can be replaced, either completely or partially, with oxidizing gas, which is introduced into the molten bath while creating turbulence therein. Subsequent to decreasing the sulphur content of the lead phase to the desired limit, for example about 0.5%, coke or some other solid carbonaceous reductant is added, to reduce the lead content of the slag to about 1%.

Upon completion of the oxygen charge, flux is introduced, for example lime, iron oxide and granulated fayalite slag. The amount of flux charged is measured primarily with respect to the slagging of the zinc and other readily oxidized elements present in the charge. When a substantially sulphur-free lead phase is obtained, in which case the slag will have a high lead content, additional lead-sulphide concentrate is added, as beforementioned, so as to reduce the lead content of the slag to a level beneath about 35%, whereafter coke is added to further reduce the slag to a lead content of about 1%. Upon completion of the reduction phase, the slag is removed and the lead refined in a manner known per se.

As will be understood, the proposed method enables lean or rich lead concentrates to be worked-up in one and the same furnace unit, together with lead-containing oxidic-sulphatic intermediate products. All process stages can be carried out in the same furnace unit, from the drying of the concentrates to the refining of the lead formed.

We claim:

1. A method for producing lead from moist lead sulphide concentrates and at least one of oxidic lead raw material and sulphatic lead raw material comprising:

(a) introducing granules or pellets of at least one of oxidic lead raw material and sulphatic lead raw material with the moist lead sulphide concentrate into a drum-like vessel adapted for rotation about its longitudinal axis;

(b) drying the moist lead sulphide concentrate while rotating the vessel thereby forming dried sulphide-containing granulates;

(c) heating said dried sulphide-containing granulates with a flux in a furnace to form a melt composed of a lead-containing liquid slag phase and a molten lead phase;

(d) agitating the melt;

(e) adding a reducing agent to decrease the lead content of the liquid slag; and (f) recovering the molten lead phase.

2. The method of claim 1 wherein said furnace is a stationary furnace and said agitating is caused pneumatically by introducing gas into the melt.

3. The method of claim 1 wherein said furnace is adapted for rotation and said agitating is caused by furnace rotation.

4. The method of claim 1 or claim 3 wherein said drum-like vessel and said furnace is a top-blown rotary converter which is heated with an oil-oxygen burner during the drying of the moist lead sulphide concentrate.

5. The method of claim 1 wherein the lead present in the liquid slag phase is reduced under turbulence to a lead content of about 1%, and the resulting slag phase is topped off and separated from the molten lead phase.

6. The method of claim 5 wherein the reducing agent is lead sulphide which is used to decrease the lead content in the slag phase to approximately 35%.

7. The method of claim 5 or claim 6 wherein coke or some other solid carbonaceous material is used to decrease the lead content of the slag phase from 35% to about 1%.

8. The method of claim 1 wherein the lead content of the liquid slag phase is initially increased by adding further oxidic lead raw materials thereby oxidizing any sulphur present in the molten lead phase.

9. The method of claim 8 wherein after the lead content of the liquid slag phase is increased coke or other solid carbonaceous material is added as the reducing agent in an amount sufficient to decrease the lead content of the slag to about 1%.

10. The method of claim 1 wherein the moist lead concentrate has a moisture content of from 10 to 20%.

11. The method of claim 1 wherein the dried sulphate-containing granulates are at least partially roasted prior to being mixed with the flux.

* * * * *